US011807345B2

(12) United States Patent
Neidert

(10) Patent No.: US 11,807,345 B2
(45) Date of Patent: Nov. 7, 2023

(54) MODULAR FLOTATION DEVICE

(71) Applicant: Tillicum International, Inc., Brigham City, UT (US)

(72) Inventor: David R. Neidert, Mantua, UT (US)

(73) Assignee: Tillicum International, Inc., Brigham City, UT (US)

( * ) Notice: Subject to any disclaimer, the term of this patent is extended or adjusted under 35 U.S.C. 154(b) by 264 days.

(21) Appl. No.: 17/230,939

(22) Filed: Apr. 14, 2021

(65) Prior Publication Data

US 2021/0316820 A1 Oct. 14, 2021

(51) Int. Cl.

| | |
|---|---|
| ***B63B 7/02*** | (2020.01) |
| ***B63B 35/38*** | (2006.01) |
| ***B63B 1/12*** | (2006.01) |
| ***B63B 7/04*** | (2020.01) |
| ***B63H 16/06*** | (2006.01) |
| ***B63B 3/08*** | (2006.01) |
| *B63H 20/06* | (2006.01) |

(52) U.S. Cl.

CPC ..... *B63B 7/02* (2013.01); *B63B 1/121* (2013.01); *B63B 7/04* (2013.01); *B63B 35/38* (2013.01); *B63B 2001/123* (2013.01); *B63B 2003/085* (2013.01); *B63H 20/06* (2013.01); *B63H 2016/063* (2013.01)

(58) Field of Classification Search

CPC ..... B63B 1/121; B63B 2001/123; B63B 3/08; B63B 2003/085; B63B 2007/003; B63B 2007/006; B63B 7/02; B63B 7/04; B63B 34/23; B63B 35/34; B63B 35/36; B63B 35/38

See application file for complete search history.

(56) References Cited

U.S. PATENT DOCUMENTS

| | | | | |
|---|---|---|---|---|
| 3,221,696 | A * | 12/1965 | Gardner | B63B 35/38 441/35 |
| 3,522,618 | A * | 8/1970 | Stranzinger | E02B 3/064 14/27 |
| 4,627,372 | A | 12/1986 | Douglas, III | |
| 4,655,156 | A * | 4/1987 | Svirklys | B63B 35/38 114/267 |
| 4,829,926 | A | 5/1989 | Voelkel | |
| 5,606,929 | A * | 3/1997 | Huang | B63B 35/38 114/77 R |
| 7,461,607 | B2 | 12/2008 | Reilly et al. | |
| 7,587,986 | B2 | 9/2009 | Neidert et al. | |

(Continued)

FOREIGN PATENT DOCUMENTS

| | | | |
|---|---|---|---|
| DE | 1531582 | A1 * | 3/1970 |
| WO | WO 2012/032198 | A2 | 3/2012 |

*Primary Examiner* — Ajay Vasudeva

(57) ABSTRACT

A modular flotation device comprises a first elongated rigid pontoon module comprising a first pontoon section and a second pontoon section, a second elongated rigid pontoon module comprising a third pontoon section and a fourth pontoon section, and an intermediate frame module comprising longitudinal members extending substantially parallel to the first and second elongated rigid pontoon modules, and lateral members extending substantially perpendicular to the first and second elongated rigid pontoon modules. The first, second, third, and fourth pontoon sections can comprise identical connection profiles and are interchangeable with one another.

16 Claims, 7 Drawing Sheets

(56) References Cited

U.S. PATENT DOCUMENTS

| | | | | |
|---|---|---|---|---|
| 8,079,320 | B1 * | 12/2011 | Suriani | B63B 35/38<br>114/263 |
| 8,132,523 | B2 | 3/2012 | White, Jr. | |
| 8,327,792 | B2 | 12/2012 | Ohman et al. | |
| 8,656,856 | B1 | 2/2014 | Morrow | |
| 9,688,357 | B1 | 6/2017 | Chen | |
| 9,856,001 | B2 * | 1/2018 | Beer | B63B 1/121 |
| 10,427,769 | B1 | 10/2019 | Garrett | |
| 10,882,437 | B2 | 1/2021 | Smith | |
| 2001/0032574 | A1 * | 10/2001 | Newton | B63B 35/34<br>114/61.1 |
| 2008/0236467 | A1 | 10/2008 | Wyman | |

* cited by examiner

MODULAR FLOTATION DEVICE

PRIORITY CLAIM

This application claims the benefit of U.S. Provisional Patent Application Ser. No. 63/009,719, filed Apr. 14, 2020, which is hereby incorporated herein by reference in its entirety.

BACKGROUND

In the 1980's and 90's personal float tubes and pontoon boats, typically constructed with inflatable doughnut-shaped or cigar-shaped floats, became quite popular with sport fishermen. Most of these devices rely on inflatable pontoons that have a thin flexible membrane or bladder filled with pressurized air. The bladders are often covered with a woven skin material to improve the appearance and durability. These prior art devices are very lightweight, easily portable, and can be folded into a compact space. However, because they are relatively thin, typical inflatable pontoons are susceptible to punctures. They are also highly susceptible to changes in temperature and barometric pressure. They are often inflated in the cool morning air at a lower elevation. The relative internal pressure can increase dramatically if transported to a higher elevation and/or with exposure to the heating of the afternoon sun.

In the late 1990's, rigid personal pontoon boats gained popularity as they provided robust solutions for the puncture and other pressure variation problems previously associated with inflatables. Examples of such rigid designs can be found in U.S. Pat. No. 7,587,986 B2, the contents of which are incorporated by reference. However, the transportability of rigid pontoon boats can become an issue, especially for those of larger lengths and higher weight carrying capacities. Many passenger sedans and SUVs are not large enough to transport them, even when broken down into sections, without resorting to roof racks or trailers.

Shortly after the rise of rigid personal pontoon boats and float tubes, plastic molded sit-on-top fishing kayaks became popular and offered large carrying capacities, with some models able to accommodate two adults. However, fishing kayaks also have their limitations. Transportability is an obvious issue, as fishing kayaks can vary from 10 to 15 feet or more in length. Cost is also a factor, with kayaks often costing several times that of a personal pontoon boat. Finally, kayaks have the potential to be more unstable in the water than a pontoon boat. They offer good initial stability however some users have reported capsizing when attempting to stand or when reaching over the sides.

SUMMARY OF THE INVENTION

Considering the problems and deficiencies described above, the present disclosure is directed to a modular flotation device that overcomes these deficiencies by providing a modular personal flotation system with interchangeable and interlocking rigid pontoon sections. The modular flotation device (or pontoon boat or kick boat) can comprise various pontoon modules having various pontoon sections that fit together to form the pontoon modules and one or more variants of a modular flotation device. The pontoon sections of each pontoon module are designed to be coupled together during use but provide the option of break-down or disassembly for easier transport inside a smaller size vehicle and to also facilitate efficient storage. Furthermore, a damaged pontoon section can be easily interchanged with a new pontoon section.

According to one example, a modular flotation device comprises a first elongated rigid pontoon module comprising a first pontoon section and a second pontoon section, a second elongated rigid pontoon module comprising a third pontoon section and a fourth pontoon section, and an intermediate frame module comprising longitudinal members extending substantially parallel to the first and second elongated rigid pontoon modules, and lateral members extending substantially perpendicular to the first and second elongated rigid pontoon modules.

The first, second, third, and fourth pontoon sections can comprise identical connection profiles and are interchangeable with one another to form the first and second pontoon modules, respectively. Each of the first, second, third, and fourth pontoon sections can comprise a non-directional first end, and a second end opposite the first end. The second end can comprise a connection profile having a top projection with a top surface extending coplanar with an upper surface of the pontoon section, a top depression adjacent to the top projection, a bottom projection below the top depression, and a bottom depression below the top projection. The top projection of the first and second pontoon sections can be received in the top depression of the second and first pontoon sections, respectively, and the bottom projection of the first and second pontoon sections can be received in the bottom depression of the second and first pontoon sections, respectively, thereby mating the first and second pontoon sections to form the first pontoon module. Similarly, the top projection of the third and fourth pontoon sections can be received in the top depression of the fourth and third pontoon sections, respectively, and the bottom projection of the third and fourth pontoon sections can be received in the bottom depression of the fourth and third pontoon sections, respectively, thereby mating the third and fourth pontoon sections to form the second pontoon module.

Longitudinal grooves can be formed in the pontoon sections to receive longitudinal members of the intermediate frame. In some examples, these can be formed in the upper surface of each of the pontoon sections and adjacent to a first side surface and a second side surface of the pontoon sections. One or more recesses can be formed in the upper surface of each of the pontoon sections. In one example, the recess can be configured to extend between a first side surface and a second side surface, and can comprise a size that facilitates adjustability of the intermediate frame relative to the pontoon modules. Upon joining and connecting the pontoon sections to form the pontoon modules, longitudinal members of the intermediate frame can be received within respective longitudinal grooves of end to end pontoon sections of each pontoon module. Lateral members of the intermediate frame can be received within respective recesses of side by side pontoon sections (e.g., a single or individual lateral members can be received within the recesses of the first and third pontoon sections, and a single or individual lateral member can be received within the recesses of the second and fourth pontoon sections). A position of the lateral members of the intermediate frame received in the respective recesses can be longitudinally adjustable within the recesses, thus facilitating adjustment of the intermediate frame relative to the pontoon modules.

In some examples, the modular flotation device can comprise fasteners connecting the first and second pontoon sections together, and connecting the third and fourth pontoon sections together. In one example, the fasteners can comprise a bolt that is inserted into a T-nut molded into the top depression of each of the first, second, third and fourth pontoon sections, respectively.

The modular flotation device can comprise straps. The intermediate frame module can be secured to the first and second pontoon modules by looping the straps over the longitudinal members received in the longitudinal grooves. The lateral members of the intermediate frame can be secured to the longitudinal members of the intermediate frame.

In some examples, the modular flotation device can comprise a seat module that is releasably connected to the intermediate frame and comprises a seat bottom and a seat back that is operable to pivot relative to the seat bottom. The modular flotation device can also comprise a seat swivel operable to facilitate rotation of the seat module. The seat module can be releasably connected to the intermediate frame via the seat swivel.

In some examples, the top projection, the top depression, the bottom projection, and the bottom depression can each comprise a tapered surface. Each of the first, second, third, and fourth pontoon sections can be comprised of a continuous wall defining a hollow interior. Each of the first, second, third, and fourth pontoon sections can comprise a removable scaling hatch lid operable to allow access to the hollow interior.

In some examples, the intermediate frame can comprise a plurality of ladder sections that can be selectively assembled and disassembled. The plurality of ladder sections can comprise a right-hand side section, a left-hand side section, a center seat section, and a rear cargo rack section. Adjustable foot rests can be inserted into a front of the right-hand side section and the left-hand side section. The rear cargo rack section can be operable to mount a battery box and support an electric trolling motor. The right-hand side section and the left-hand side section can comprise oar locks operable for securing oars used to propel the modular flotation device.

In some examples, the modular flotation device can comprise a transport module selectively attachable to the intermediate frame module. The transport module can comprise a stowed position for when the modular flotation device is in water and an extended or deployed position to facilitate land transport of the modular flotation device.

In one example a first pontoon section is provided and can comprise a first end and a second end opposite the first end. The second end can comprise a connection profile having a top projection, a top depression adjacent to the top projection, a bottom projection below the top depression, and a bottom depression below the top projection.

In some examples, the connection profile is operable to mate to a second pontoon section having an identical connection profile as the connection profile of the first pontoon section. The first end can comprise a non-directional end.

The present disclosure also sets forth a method of configuring a modular flotation device comprising first and second elongated rigid pontoon modules. The method can comprise joining a first pontoon section to a second pontoon section to form a first elongated rigid pontoon module by mating a connection profile of the first pontoon section to an identical connection profile of the second pontoon section. Top projections of the connection profile of the first pontoon section can be inserted into top depressions of the connection profile of the second pontoon section, respectively, these having identical connection profiles, and bottom projections of the connection profile of the first pontoon section can be inserted into bottom depressions of the connection profile of the second pontoon section, again, these having identical connection profiles, to form the first pontoon module. The method can further comprise joining a third pontoon section to a fourth pontoon section to form a second pontoon module in the same manner as each of the first, second, third, and fourth pontoon sections are interchangeable and comprise the same connection profile.

The method can further comprise mating an intermediate frame module to the first pontoon module by inserting longitudinal members of the frame module into corresponding longitudinal grooves formed in the pontoon sections, such as in laterally spaced apart grooves formed in an upper surface adjacent to a first side surface of a second side surface, respectively, of each of the first and second pontoon sections, and inserting lateral members of the frame module into corresponding recesses formed in the upper surface between the first side surface and the second side surface of each of the first and second pontoon sections. This method can further comprise mating the intermediate frame module to the second pontoon module by inserting additional longitudinal members of the frame module, and inserting lateral members of the frame module, into respective grooves and recesses of the third and fourth pontoon sections of the second pontoon module.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Figure 1:
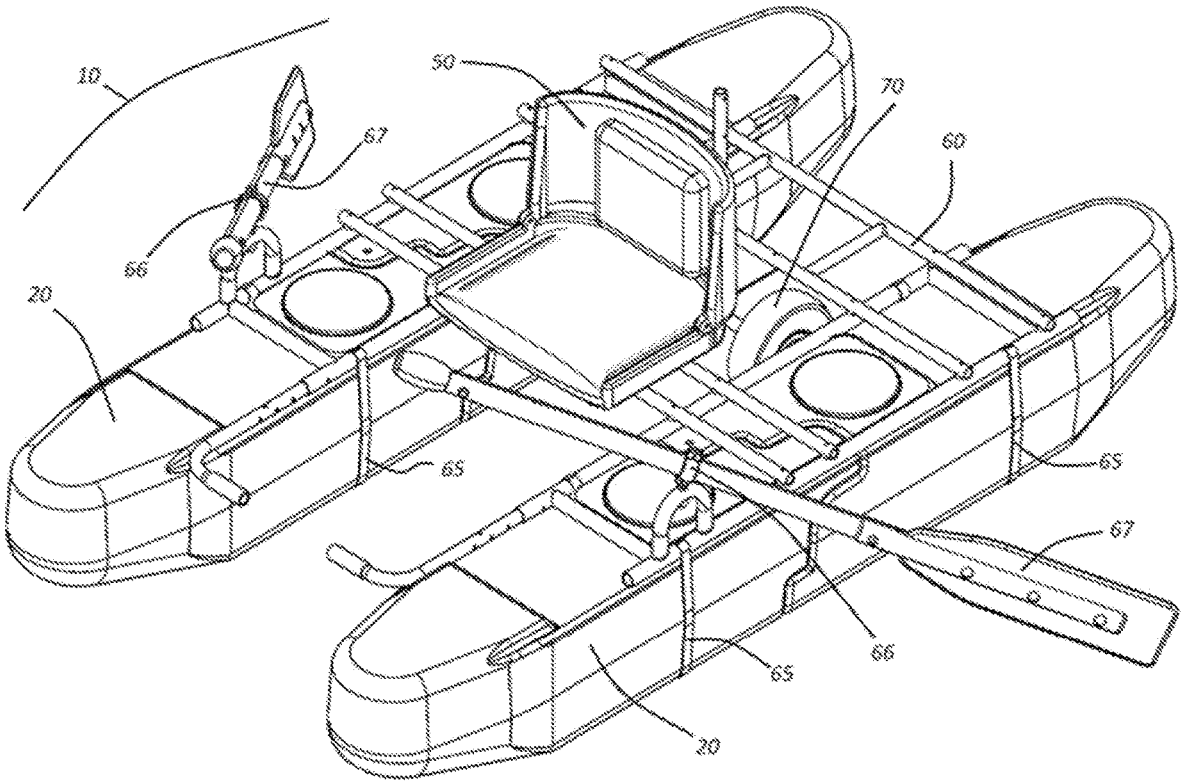
FIG. 1 is a perspective view of a modular flotation device in accordance with an exemplary embodiment of the present invention.
Figure 2:
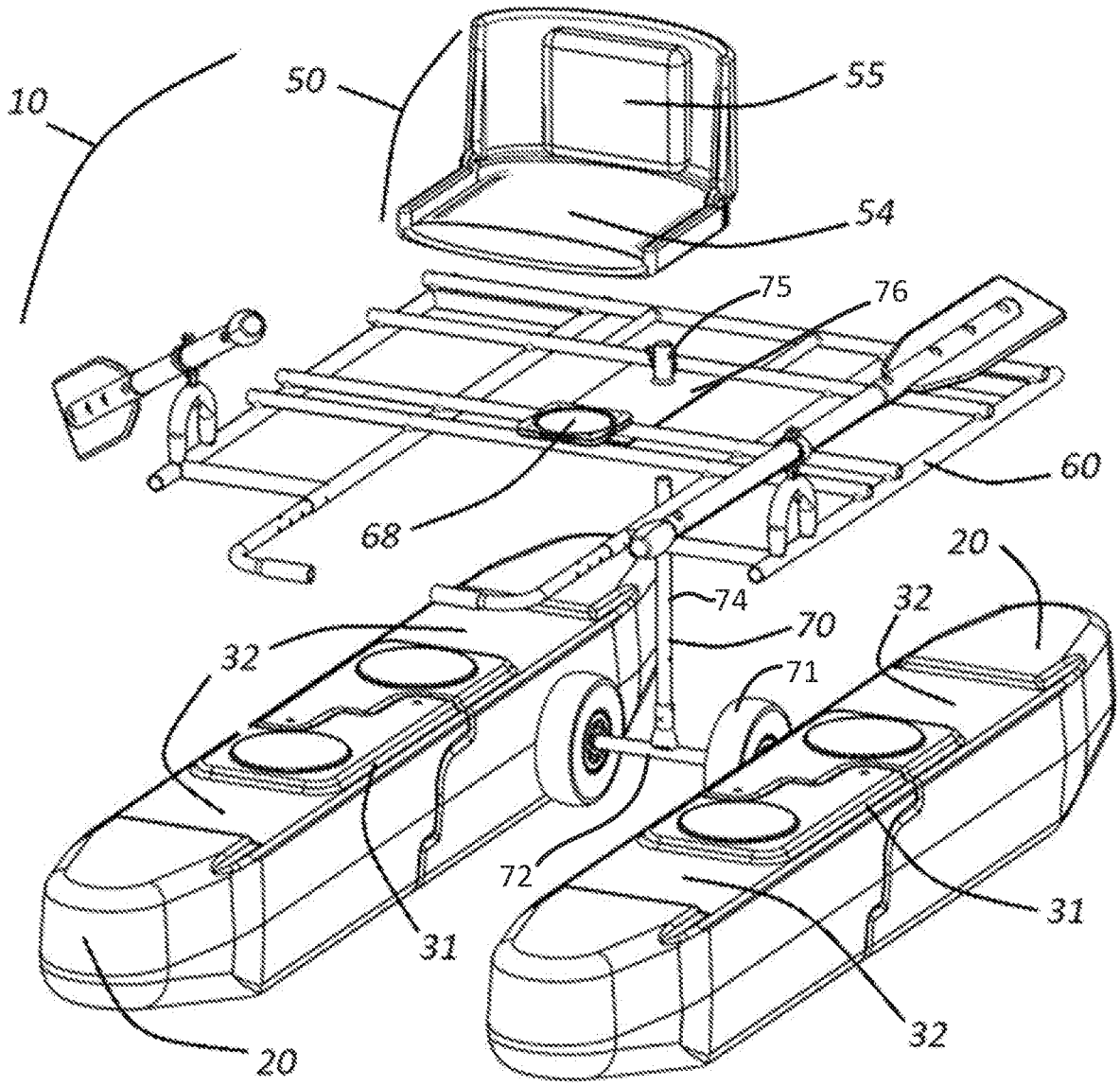
FIG. 2 is an exploded view of the modular flotation device of FIG. 1.

As illustrated in FIGS. 1 and 2, a modular flotation device, otherwise known as a pontoon boat or kick boat is provided, indicated generally as 10. The modular flotation device comprises a plurality of rigid, elongated, pontoon modules 20. In the present embodiment shown in FIG. 1, two pontoon modules 20 are provided with one pontoon module 20 being positioned on each side of the modular flotation device 10. However, this is not intended to be limiting in any way. Indeed, those skilled in the art will appreciate that multiple pontoon modules 20 can be incorporated in a modular flotation device, such as three or more pontoon modules.

The first and second pontoon modules 20 can each be comprised of a plurality of separately molded pontoon sections 30 which will be described in more detail below. In this embodiment, the pontoon modules 20 are shown as comprising two pontoon sections 30 (i.e., first and second pontoon sections form the first pontoon module, and third and fourth pontoon sections form the second pontoon module). However, three or more pontoon sections 30 can be used to form each of the pontoon modules 20.

The modular flotation device 10 can further comprise an intermediate frame module 60 and a seat module or seat assembly 50. The seat assembly 50 can be releasably attached to the intermediate frame module 60 via a seat swivel 68. The seat swivel is operable to allow a user to rotate the seat assembly 50 for easier access to gear kept behind the seat assembly 50, and for more comfortable steering should the user mount a supplemental propulsion system behind the seat assembly 50, such as an electric trolling motor. The seat assembly 50 can comprise a seat bottom 54 and a seat back 55. The seat bottom 54 and the seat back 55 can comprise a padded surface for comfort. The seat back 55 can pivot relative to the seat bottom 54 to allow the seat back 55 to fold flat. The seat assembly 50 can be formed from injection molded plastic material. However, other materials can also be used. As such, the seat assembly 50 is not limited to injection molded plastics in any way.

Figure 3:
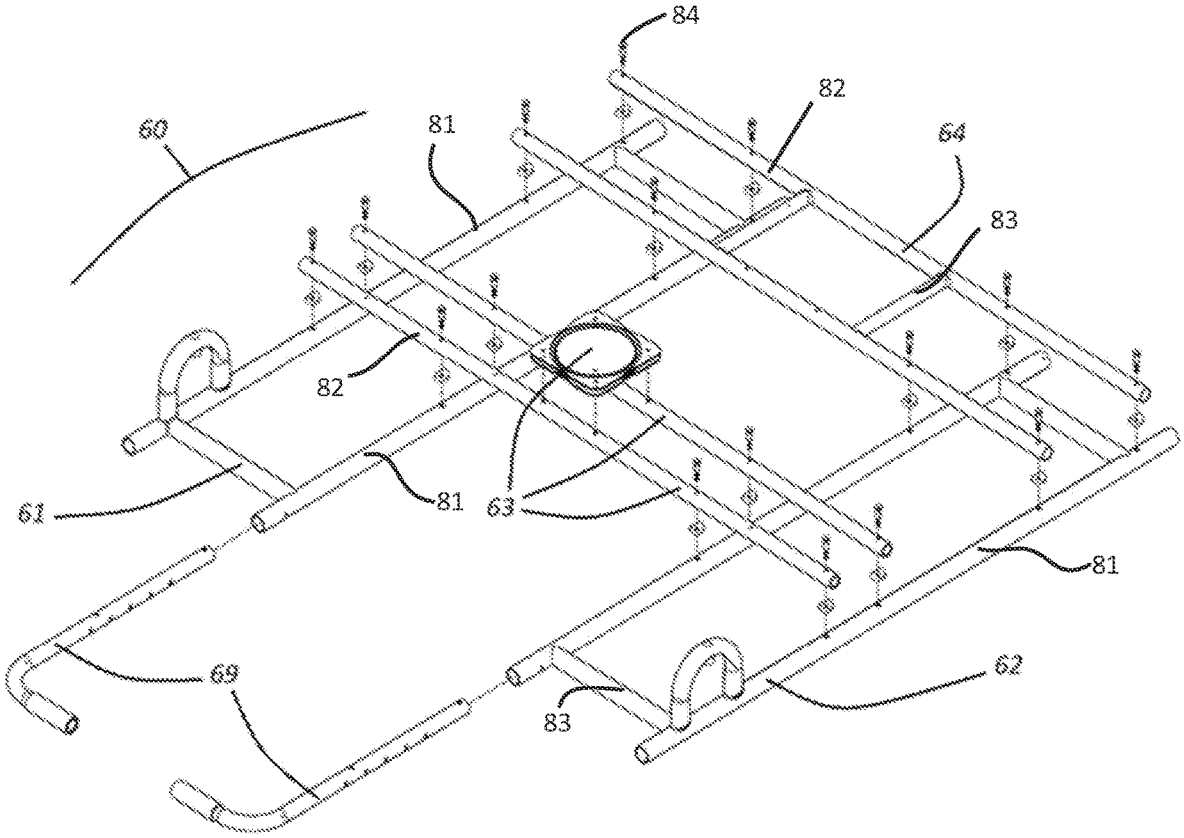
FIG. 3 is an exploded view of four intermediate frame module ladder sections of a frame module of the modular flotation device of FIG. 1.
Figure 4:
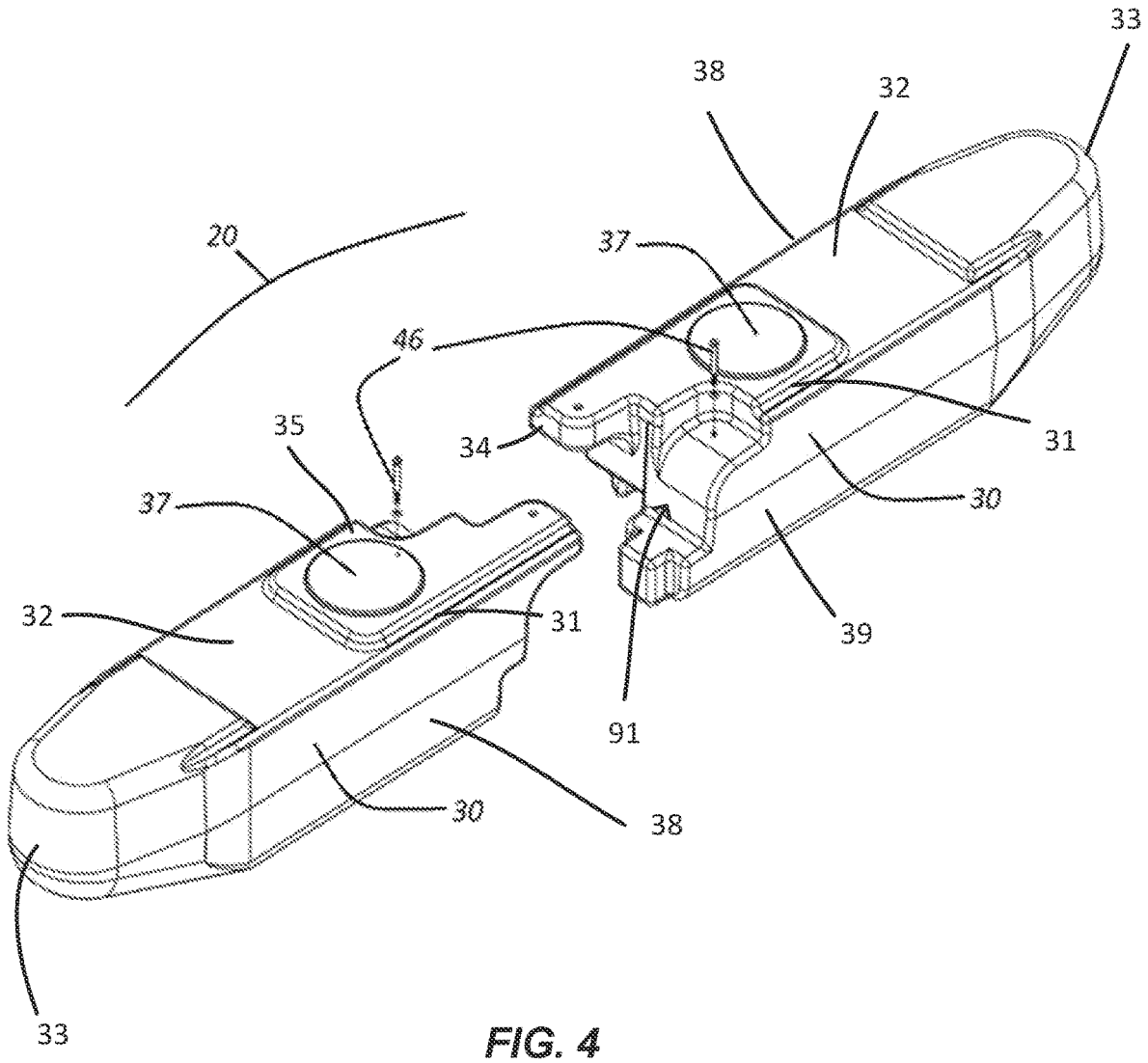
FIG. 4 is a perspective view of two pontoon sections of a pontoon module of the modular flotation device of FIG. 1.

Referring to FIGS. 1-3, the intermediate frame module 60 can comprise a plurality of longitudinal members 81 extending substantially parallel to the pontoon modules 20 and a plurality of lateral members 82 extending substantially perpendicular to the pontoon modules 20. The longitudinal members 81 and lateral members 82 can be releasably joined by intermediate members 83 to form ladder sections of the intermediate frame module 60. In this embodiment, the intermediate frame module 60 can comprise a right-hand side ladder section 61, a left-hand side ladder section 62, a center seat ladder section 62, and a rear cargo rack ladder section 64. The ladder sections 61, 62, 63, 64 forming the intermediate frame module 60 can be selectively assembled and disassembled. When in the disassembled state, the intermediate frame module can be easily stored and/or transported. The intermediate frame module 60 can then be easily and quickly reassembled prior to use. The ladder sections 61, 62, 63, 64 of the intermediate frame 60 can be assembled via fasteners 84 to form the assembled intermediate frame module 60

The intermediate frame module 60 can be constructed from a lightweight aluminum alloy to provide sufficient strength while also having a relatively light weight. Such alloys can also be resistant to bending when loaded. Other metals or alloys other than aluminum, as well as plastic materials, can also be used.

The intermediate frame module 60 can further comprise adjustable foot rests 69. The adjustable foot rests 69 can be inserted into longitudinal members 81 of the right-hand side and left-hand side ladder sections 61, 62.

The intermediate frame module 60 can also comprise a transport module 70 to facilitate transport of the modular flotation device 10 over land. The transport module 70 can comprise wheels 71 mounted to an axle 72. The transport module 70 can comprise a vertical member 74 that extends through a connection member 75 of a transport module mount 76 attached to the intermediate frame module 60. The vertical member 74 can be operable to alternate between an extended or deployed position and a stowed or retracted position. The wheels 71 can be lowered in the extended or deployed position to facilitate transport of the modular flotation device 10 on land and can be raised in the stowed or retracted position so as to be out of the water during use of the modular flotation device 10. The adjustable foot rests 69 can be used as handles when utilizing the transport module 70 to move the modular flotation device 10 overland.

The intermediate frame module 60 can further comprise oar locks 66 that receive and that facilitate the use of oars 67 for rowing to propel the modular flotation device 10. While oars 67 are shown in the present embodiment, other propulsion methods can be used such as a user wearing and actuating swimming fins or flippers (from where the name "kick-boat" is derived) or via a motor attached to the intermediate frame module 60. For example, the rear cargo ladder section 64 of the intermediate frame module 60 can provide a mounting point for a battery box and transom for an electric trolling motor (not shown).

The intermediate frame 60 can be attached to the pontoon modules 20 via webbing straps. The webbing straps 65 can be nylon webbing straps that are looped over the longitudinal members 81 of the right-hand side ladder section 61 and the left-hand side ladder section 62. The straps can be routed around and under the pontoon modules 20 and tightened using a cam-lock metal buckle. In some embodiments, such as where the module flotation device 10 may be dragged over sharp ice or rocks where the straps could be damaged, the straps can be supplemented or replace by clamping tubes (not shown) that are tightened on top of the right- and left-hand side ladder sections 61, 62 via fasteners that thread into the pontoon modules 20.

Referring to FIGS. 1, 2, 4, 5, 6A, and 6B, the pontoon modules 20 will now be described. As mentioned above, the first and second pontoon modules 20 can each be formed from two or more pontoon sections 30 having identical connection profiles that allow them to be interchangeable with one another end to end and side to side, such that any four pontoon sections can be joined together in any order to form two pontoon modules, for instance. Each pontoon section 30 of the pontoon modules 20 can be comprised of a continuous wall that defines its shape. The wall is rigid and is resistant to punctures. The wall forms a hollow pontoon section that requires no inflation, such as via an air pump or air compressor. The hollow space inside the pontoon section 30 can be a dry storage compartment in some instances.

The pontoon sections 30 can be rigid and seamless and can be formed of a linear low-density polyethylene (LLDPE) or high-density polyethylene (HDPE) polymer material. Several different processes can be used to form the pontoon sections, such as by rotational molding or by blow molding. In the rotational molding process, the polymer material in the form of a powder is placed inside a mold. The mold is then heated as it is rotated, causing the powder to melt inside, and to form the desired item. Regulation of the temperature of various portions of the mold can be used to control the wall thickness of the resulting product. Higher temperatures produce a greater thickness than lower temperature areas. Although the pontoon sections 30 are described in this example as being made of a LLDPE suitable for rotational molding, or HDPE for blow molding, other materials exhibiting similar capabilities can be readily substitutable and are contemplated herein.

Given the design, the pontoon module 20 formed from the pontoon sections 30 described herein is almost completely resistant to loss of flotation. The rigid configuration of the pontoon sections 30 also makes them relatively immune to pressure variations due to temperature or elevation changes. Consequently, if the modular flotation device 10 including the pontoon sections 30 are transported when temperatures are low, the pontoon sections 30 will keep their shape and will not fail when the ambient temperature increases or when the ambient pressure drops due to an increase in elevation. This allows the pontoon modules 20 to retain their full buoyancy in a much wider variety of conditions as compared to a thin membrane inflatable boat, which will sometimes require periodic inflation or deflation. A partially inflated pontoon boat is also more difficult to propel through the water, by fins, oars, or with an electric trolling motor, where the performance of a rigid boat is unaffected by such changes in ambient conditions.

Each pontoon section 30 comprises a first end 33 which can be non-directional meaning it can function as either the bow or stern of an assembled pontoon module 20. In one aspect, the first end 33 can be a rounded, blunt shaped end. Opposite the first end 33 is a second end 34. The second end 34 of the pontoon section 30 can comprise a mating and connecting end that comprises a connection profile 91. The connection profile 91 of the second end 34 is configured to allow two pontoon sections 30 to easily slide and mate together for quick assembly and disassembly of a pontoon module 20 in the field, while providing a secure and structurally sound mechanical connection during use. The connection profile 91 is described in further detail below.

The pontoon sections 30 can each further comprise a first side surface 38, a second side surface 39 opposite the first side surface 39, and an upper surface 35. The upper surface can comprise a removable hatch lid 37 that can selectively provide access to and seal a dry storage area inside of the pontoon section 30. The pontoon sections 30 can each comprise one or more longitudinal grooves formed on or formed in the upper surface, one or both of the side surfaces of the pontoon section 30, or a combination of these, each sized and configured to receive a longitudinal member 81 of the intermediate frame module 60. In one example, the pontoon section 30 can comprise two laterally spaced apart longitudinal grooves 31 formed in the upper surface 35, wherein a first longitudinal groove 31 is formed in the upper surface 35 adjacent to the first side surface 38, and a second longitudinal groove 31 is formed in the upper surface 35 adjacent the second side surfaces 39. The longitudinal grooves 31 can be sized and configured to capture respective longitudinal members 81 of the right-hand side and left-hand side ladder sections 61, 62 of the intermediate frame module 60 when the modular flotation device 10 is assembled. The interface between the longitudinal grooves 31 and the longitudinal members 81 prevents relative lateral movement between the pontoon modules 20 and the intermediate frame module 60 when the modular flotation device 10 is assembled.

The upper surface 35 of each of the pontoon sections can further comprise a recess 32 sized and configured capture respective lateral members 82 of the right-hand side and left-hand side ladder sections 61, 62 of the intermediate frame module 60 when the modular flotation device 10 is assembled. In one example, the recess 32 can be formed into the upper surface 35 and sized and configured so as to extend between the first side surface 38 and the 20 second side surface 39. In one example, the recess 32 can be size and configured such that no fore to aft adjustment of the intermediate frame module 60 is facilitated. In another example, the fore to aft or longitudinal length of the recess 32 can be sized and configured to provide for front-to-back adjustment of the intermediate frame module 60 relative to the pontoon modules 20, allowing a user to make trim adjustments. In still another example, multiple recesses can be formed in the upper surface 35 to facilitate front-to-back adjustment of the intermediate frame module 60 on top of the pontoon modules 20. In this way, the modular flotation device 10 can be adjusted so as to float level in the water when, for example, there is added weight in the rear of the boat due to carrying extra gear or supplemental propulsion equipment.

Figure 5:
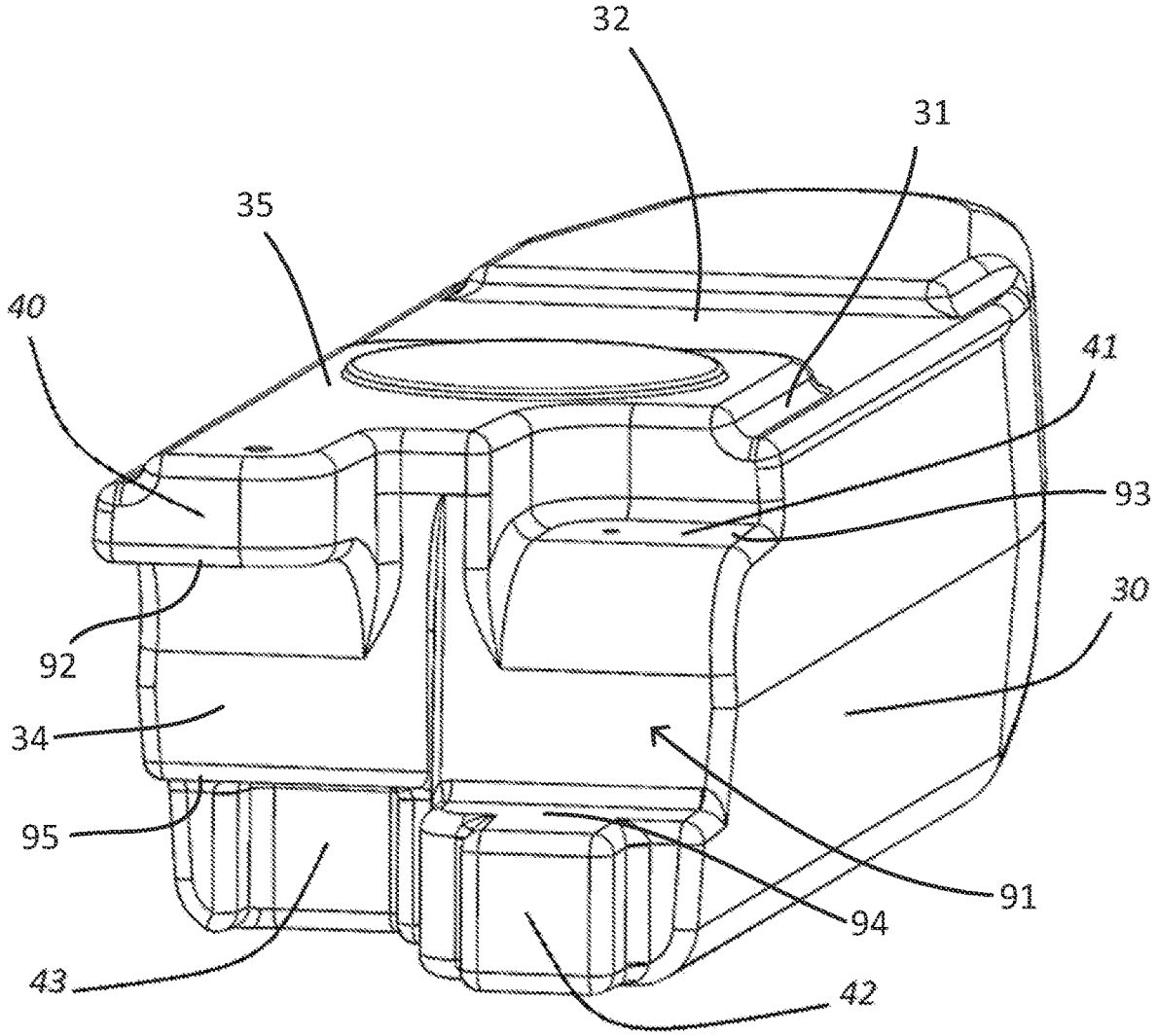
FIG. 5 is a perspective view of a pontoon section of the modular flotation device of FIG. 1 showing details of a connection profile.
Figure 6A:
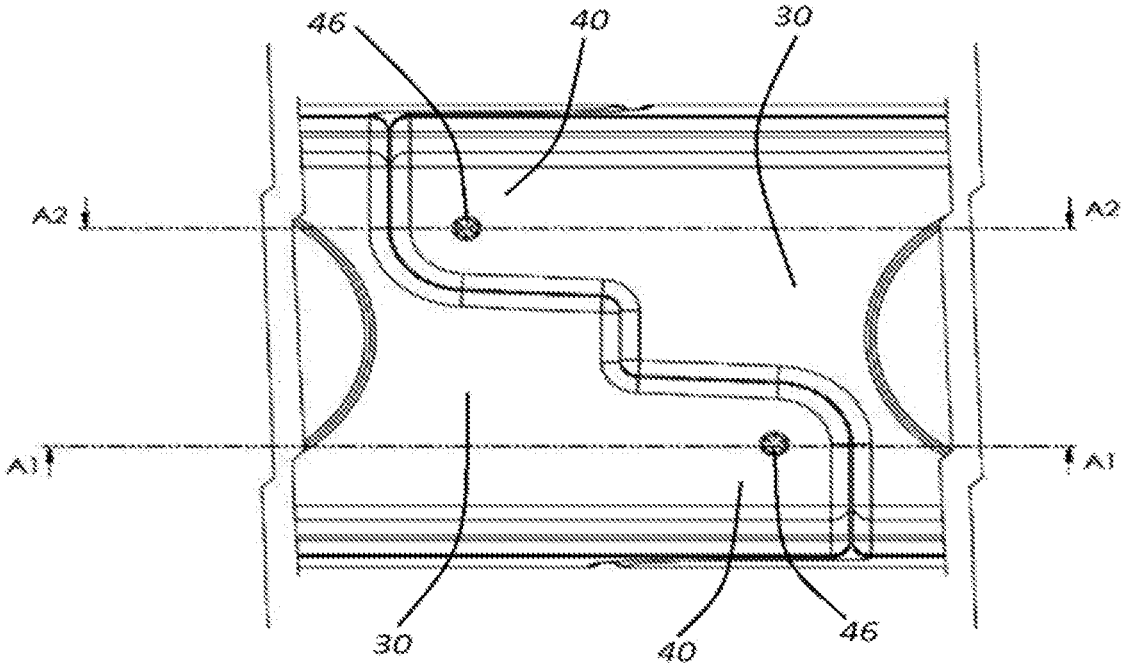
FIG. 6A is a partial top view of the modular flotation device of FIG. 1
Figure 6B:
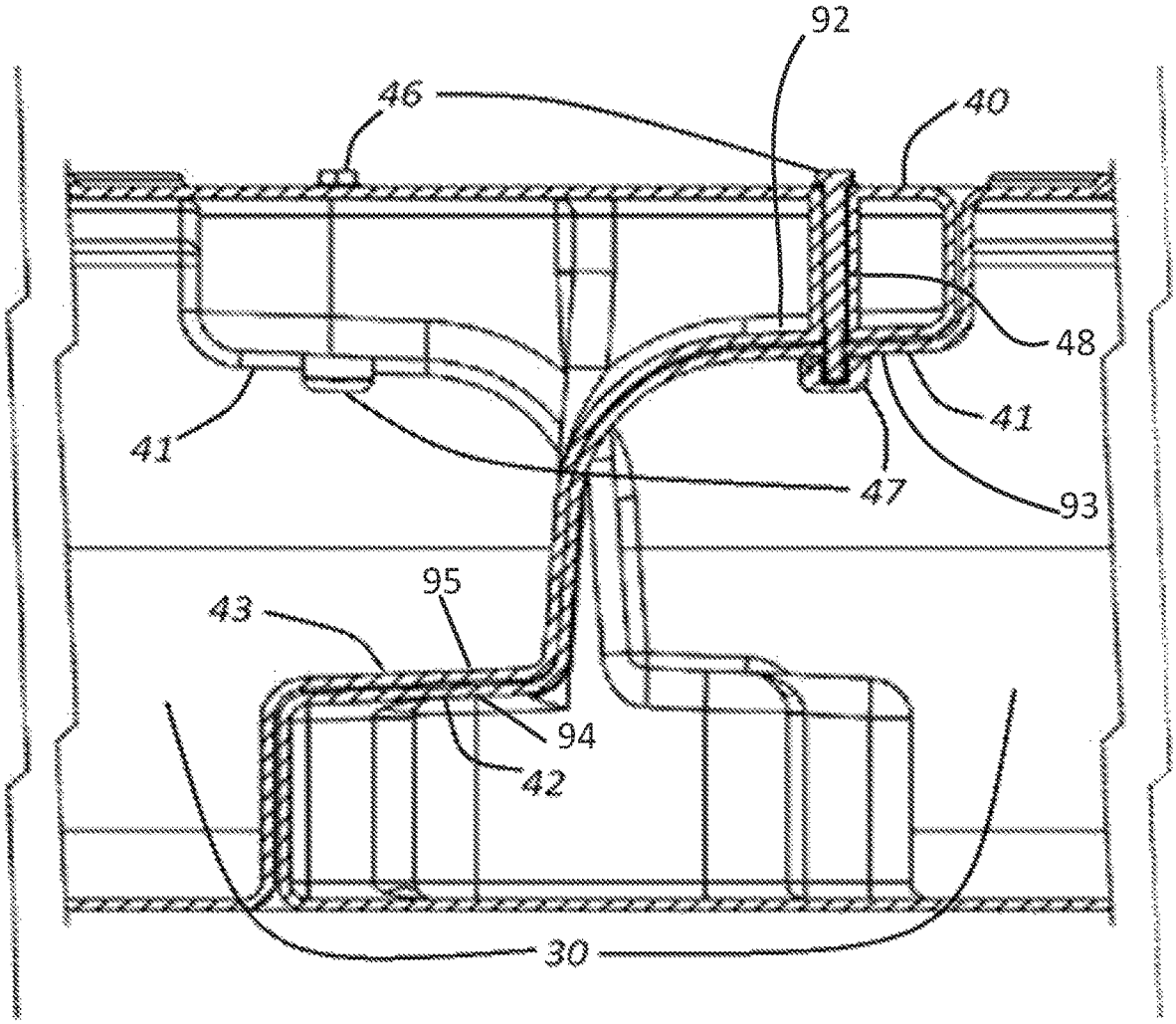
FIG. 6B is a cross-section view taken along either section A1 or A2 of FIG. 6A.

Referring to FIGS. 5, 6A, and 6B, the connection profile 91 will be described. The connection profile 91 can be sized and configured for quick, easy assembly and disassembly of various pontoon sections 30 as the connection profile 91 on each of the pontoon sections to be joined are the same. By having the same connection profiles 91, this facilitates one pontoon section having a connection profile 91 to interface with and to be joined to any other pontoon section also having the same connection profile 91 to form a pontoon module 20. In the example shown, the pontoon modules 20 each comprise two pontoon sections 30, each pontoon section 30 having a connection profile 91 that are the same. As will be discussed below, in some examples a pontoon module can comprise more than two pontoon sections. For example, one or more intermediate pontoon sections having the same connection profile 91 at each end can be joined to two of the pontoon sections 30 to form a longer pontoon module. As such, in some examples, the pontoon sections 30 shown in the drawings can be considered end pontoon sections.

The present application contemplates different possible configurations of connection profiles, and as such, any connection profiles discussed herein are not intended to be limiting in any way. In one example, the connection profile 91 can comprise a top tab or top projection 40, a top shelf or top depression 41 adjacent to the top projection 40, a bottom tab or bottom projection 42 below the top depression 41, and a bottom shelf or bottom depression 43 below the top projection 40. When two pontoon sections 30 are joined together, the connection profiles 91 of the two pontoon sections 30 are aligned and mated together, such that respective top projections 41 of first and second pontoon sections 30 are inserted into corresponding respective top depressions 41 of the first and second pontoon sections 30. Likewise, respective bottom projections 42 of the first and second pontoon sections 30 are inserted into corresponding respective bottom depressions 43 of first and second pontoon sections 30. The connection profiles 91 of the two pontoon sections 30 comprise a number of connecting or interfacing surfaces designed to engage and to be seated with one another upon mating two adjoining pontoon sections. These interfacing surfaces can be part of the top and bottom projections and depressions, as well as any surfaces extending between these and the upper and lower surfaces of the pontoon sections. These surfaces can be configured in a variety of ways to engage with and to be seated against one another for the purpose of facilitating, at least in part, the mating of two adjoining pontoon sections together in a secure manner, such that the formed pontoon module models a single, rigid structure although it is made of component parts or sections. In other words, once two pontoon modules 30 are mated together, and secured using one or more fastening means, the resulting formed pontoon module acts and functions as if it were a single, rigid pontoon module.

The top projection 40 of each pontoon section 30 can comprise a top projection tapered mating surface 92 that corresponds to a top depression tapered mating surface 93 of the top depression 41 of each pontoon section 30. Similarly, the bottom projection 42 can comprise a bottom projection tapered mating surface 94 that corresponds to a bottom depression tapered mating 95 of the bottom depression 43. As two pontoon sections 30 are pushed together towards being fully assembled, the tapered mating surfaces 92, 93, 94, 95 provide for minimal contact and friction prior to the point of full mating and assembly. This minimizes effort required by the user for assembly and disassembly.

The upper surface 35 of the pontoon section 30 can be coplanar with an upper surface of the top projection 40. In other words, the upper surface 35 of the pontoon section 30 can be configured to extend continuously along the top projection 40. The top depression 41 can be formed into the upper surface 34 of the pontoon section 30. Thus, when the pontoon sections 30 are assembled into a pontoon module 20, the upper surface 35 of one pontoon section 30 is even or coplanar with the upper surface 35 of the other pontoon section 30.

To minimize relative movement between assembled pontoon sections during use, various fasteners can be used to secure the pontoon sections together. In on example, bolts 46 can be placed through clearance holes 48 molded in the top projections 40 and threaded into nuts, such as "T-nuts" that are insert molded into the top depressions 41. This provides a rigid assembly state, with minimal joint flex in any axis or angle of rotation. Any remaining flexure is stabilized by the intermediate frame module 60 being secured along the top side recesses 31 and side-to-side recesses 32 of both pontoon modules 20.

Because each of the pontoon sections 30 has the same connection profile 91 and can be manufactured to be identical to (i.e., the same as) one another, the pontoon sections 30 can be interchangeable with one another in any order. Thus, when four pontoon sections are, for example, retrieved from storage or transport to be assembled into pontoon modules 20, any two of the four pontoon sections 30 can be used to form each of the pontoon modules 20 of the modular flotation device 10. Further, should a pontoon section 30 become damaged, it can be easily replaced with another similar pontoon section 30.

Although the modular flotation device 10 described herein is shown as a personal pontoon boat, it is recognized that the features and advantages described above can find application in related flotation products such as other pontoon types and sizes. For example, a mold could be constructed to create a pontoon section with the connection profile 91 formed on both ends to be used as an intermediate pontoon section. Although the intermediate pontoon section would not be interchangeable with end pontoon sections 30, it can still comprise the same connection profile on each of its ends so as to be able to mate with and to be joinable to these. An intermediate pontoon section can be joined together with one or more additional intermediate pontoon sections and between two other end pontoon sections 30 having the same connection profile 91 on one of their respective ends. This could enable a long pontoon to be constructed for use in a boat or other flotation application using the pontoon sections 30 and one or more intermediate pontoon sections, while still providing for easy transportation and storage. Another application might be in producing a two-piece kayak, where a seat rail system could reinforce the center joint and allow a long kayak (such as a 12' long kayak) to be transported in a pickup truck bed (such as a 6½' long truck bed) with the tailgate closed.

The modular flotation device described herein can provide significant advantages over prior related inflatable pontoon boats, previous rigid pontoon boats, and fishing kayaks. For example, the modular flotation device comprising rigid pontoon modules has superior durability characteristics as compared to that of inflatable pontoons, such as being virtually immune to punctures. This can improve water safety for users. Other advantages of a rigid structure include not requiring periodic inflation and/or deflation, being more tolerant of significant relative temperature and pressure changes than inflatable pontoons, and not substantially deforming in shape. Further, by being formed from several different modules, the pontoon boat can comprise several different design variants. It is contemplated that each modular component or module can have several different designs, each fitting together to form one or more pontoon boat variants. Additionally, by forming the connection profile and interface integral with the modules the total number of parts can be reduced and assembly of the individual modules into the modular flotation device can be simplified.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A modular flotation device comprising:

a first elongated rigid pontoon module comprising a first pontoon section and a second pontoon section;

a second elongated rigid pontoon module comprising a third pontoon section and a fourth pontoon section; and an intermediate frame module comprising longitudinal members extending substantially parallel to the first and second elongated rigid pontoon modules, and lateral members extending substantially perpendicular to the first and second elongated rigid pontoon modules;

wherein the first, second, third, and fourth pontoon sections comprise the same connection profile and are interchangeable with one another, and wherein each of the first, second, third, and fourth pontoon sections comprises:

a non-directional first end;

a second end opposite the first end, the second end comprising a connection profile having a top projection with a top surface extending coplanar with an upper surface of the pontoon section, a top depression adjacent to the top projection, a bottom projection below the top depression, and a bottom depression below the top projection, such that the top projection of the first and second pontoon sections is received in the top depression of the second and first pontoon sections, respectively, and the bottom projection of the first and second pontoon sections is received in the bottom depression of the second and first pontoon sections, respectively, thereby mating the first and second pontoon sections to form the first pontoon module, and such that the top projection of the third and fourth pontoon sections is received in the top depression of the fourth and third pontoon sections, respectively, and the bottom projection of the third and fourth pontoon sections is received in the bottom depression of the fourth and third pontoon sections, respectively, thereby mating the third and fourth pontoon sections to form the second pontoon module;

laterally spaced apart longitudinal grooves formed in the pontoon section, wherein one of the longitudinal members of the intermediate frame is received within each longitudinal groove of the laterally spaced part longitudinal grooves, and a recess formed in the upper surface of the pontoon section extending between a first side surface and a second side surface, wherein one of the lateral members of the intermediate frame is received within the recess, and wherein a position of the lateral member of the intermediate frame received in the recess is longitudinally adjustable within the recess.

2. The modular flotation device of claim 1, further comprising fasteners connecting the first and second pontoon sections together, and connecting the third and fourth pontoon sections together.

3. The modular flotation device of claim 2, wherein the fasteners comprise a bolt that is inserted into a T-nut molded into the top depression of each of the first, second, third and fourth pontoon sections, respectively.

4. The modular flotation device of claim 1, further comprising straps, wherein the intermediate frame module is secured to the first and second pontoon modules by looping the straps over the longitudinal members received in the longitudinal grooves.

5. The modular flotation device of claim 1, wherein the lateral members of the intermediate frame are secured to the longitudinal members of the intermediate frame.

6. The modular flotation device of claim 1, further comprising:

a seat module that is releasably connected to the intermediate frame, the seat module comprising a seat bottom and a seat back that is operable to pivot relative to the seat bottom;

a seat swivel operable to facilitate rotation of the seat module, wherein the seat module is releasably connected to the intermediate frame via the seat swivel.

7. The modular flotation device of claim 1, wherein the top projection, the top depression, the bottom projection, and the bottom depression each comprise a tapered surface.

8. The modular flotation device of claim 1, wherein each of the first, second, third, and fourth pontoon sections is comprised of a continuous wall defining a hollow interior.

9. The modular flotation device of claim 8, wherein each of the first, second, third, and fourth pontoon sections comprises a removable sealing hatch lid operable to allow access to the hollow interior.

10. The modular flotation device of claim 1, wherein the intermediate frame comprises a plurality of ladder sections that can be selectively assembled and disassembled.

11. The modular flotation device of claim 10, wherein the plurality of ladder sections comprise a right-hand side section, a left-hand side section, a center seat section, and a rear cargo rack section.

12. The modular flotation device of claim 11, further comprising adjustable foot rests inserted into a front of the right-hand side section and the left-hand side section.

13. The modular flotation device of claim 11, wherein the rear cargo rack section is operable to mount a battery box and support an electric trolling motor.

14. The modular flotation device of claim 11, wherein the right-hand side section and the left-hand side section comprise oar locks operable for securing oars used to propel the modular flotation device.

15. The modular flotation device of claim 1, further comprising a transport module selectively attachable to the intermediate frame module, the transport module comprising a stowed position for when the modular flotation device is in water and an extended position to facilitate land transport of the modular flotation device.

16. A method of configuring a modular flotation device comprising:

joining a first pontoon section to a second pontoon section by mating a connection profile of the first pontoon section to an identical connection profile of the second pontoon section such that top projections of the connection profile and the identical connection profile are inserted into top depressions of the connection profile and the identical connection profile, respectively, and bottom projections of the connection profile and the identical connection profile are inserted into bottom depressions of the connection profile and the identical connection profile, respectively, to form a pontoon module; and mating an intermediate frame module to the pontoon module by inserting longitudinal members of the frame module into corresponding longitudinal grooves formed in each of the first pontoon section and the second pontoon section, and inserting lateral members of the frame module into corresponding recesses formed in an upper surface between a first side surface and a second side surface of each of the first pontoon section and the second pontoon section.

* * * * *